United States Patent [19]

Tokuno et al.

[11] Patent Number: 4,586,434

[45] Date of Patent: May 6, 1986

[54] DEVICE FOR REPLACING PLATE CYLINDERS

[75] Inventors: Masateru Tokuno, Nishinomiya; Tetsuya Sawada, Nishigyo; Hidetoshi Hoshiyama, Ibaraki; Toshihiro Yoneda, Takatsuki, all of Japan

[73] Assignee: Rengo Co., Ltd., Osaka, Japan

[21] Appl. No.: 729,348

[22] Filed: May 1, 1985

[30] Foreign Application Priority Data

May 17, 1984 [JP] Japan ..... 59-100860

[51] Int. Cl.[4] ..... B41F 13/00

[52] U.S. Cl. ..... 101/178; 101/219; 414/911

[58] Field of Search ..... 414/911, 285, 279, 278; 82/DIG. 5; 29/568; 101/1, 216, 219, 178, 174

[56] References Cited

U.S. PATENT DOCUMENTS

| | | | |
|---|---|---|---|
| 2,129,698 | 9/1938 | Luehrs | 414/911 X |
| 2,387,890 | 10/1945 | Egge | 414/911 X |
| 4,375,936 | 3/1983 | Dechantsreiter | 414/911 X |

*Primary Examiner*—Clifford D. Crowder

*Attorney, Agent, or Firm*—Wenderoth, Lind & Ponack

[57] ABSTRACT

A device for replacing plate cylinders for a color rotary press is proposed which includes suspending units having a bearing adapted to support one end of the shaft of a plate cylinder and to be movable in a vertical direction, and travellers for moving the suspending units in a horizontal direction, and elevator conveyors having bearings secured to a chain to support one end of the shaft of the plate cylinder and move the latter up and down.

4 Claims, 8 Drawing Figures

DEVICE FOR REPLACING PLATE CYLINDERS

The present invention relates to a device for replacing plate cylinders for a color rotary press having a plurality of plate cylinders.

On this type of color rotary press, heavy plate cylinders weighing several hundreds kilograms have to be replaced in a narrow space each time the printing pattern changes. This replacement work has so far been performed by two men each operating one chain block adapted to support one end of the shaft of a plate cylinder and move along an overhead rail. Two operators had to operate the chain blocks in coordinated timing. If timing should be bad, the suspended plate cylinder would swing, dangle or tilt, bumping the press and causing damage to the press and/or the plate cylinder. Thus the replacement work was time-consuming, inefficient and dangerous.

An object of the present invention is to provide a device for replacing a plate cylinder which allows the replacement quickly, efficiently and safely.

One feature of the present invention is that for each plate cylinder, a pair of suspending units and a pair of travellers are provided so that the plate cylinders can be replaced not one after another but all at the same time.

Another feature of the present invention is the provision of a pair of elevator conveyers which have a plurality of bearings and serve to receive the old plate cylinders from the travellers and deliver new plate cylinders to the travellers.

A further feature of the present invention is that the suspending units and the elevator conveyors have bearings adapted to engage and support each end of the shaft of the plate cylinder and that their bearings are arranged so that the plate cylinder on the bearings of the suspending units will be received by the bearings of the elevator conveyors either by moving the bearings of the suspending units downwardly past the bearings of the elevator conveyor or moving the latter upwardly past the former and so that the plate cylinder on the bearings of the elevator conveyor will be received by the bearings of the suspending units either by moving the bearings of the elevator conveyor downwardly past the bearings of the suspending units or moving the latter upwardly past the former.

Other objects and features of the present invention will become apparent from the following description taken with reference to the accompanying drawings, in which.

Figure 1:
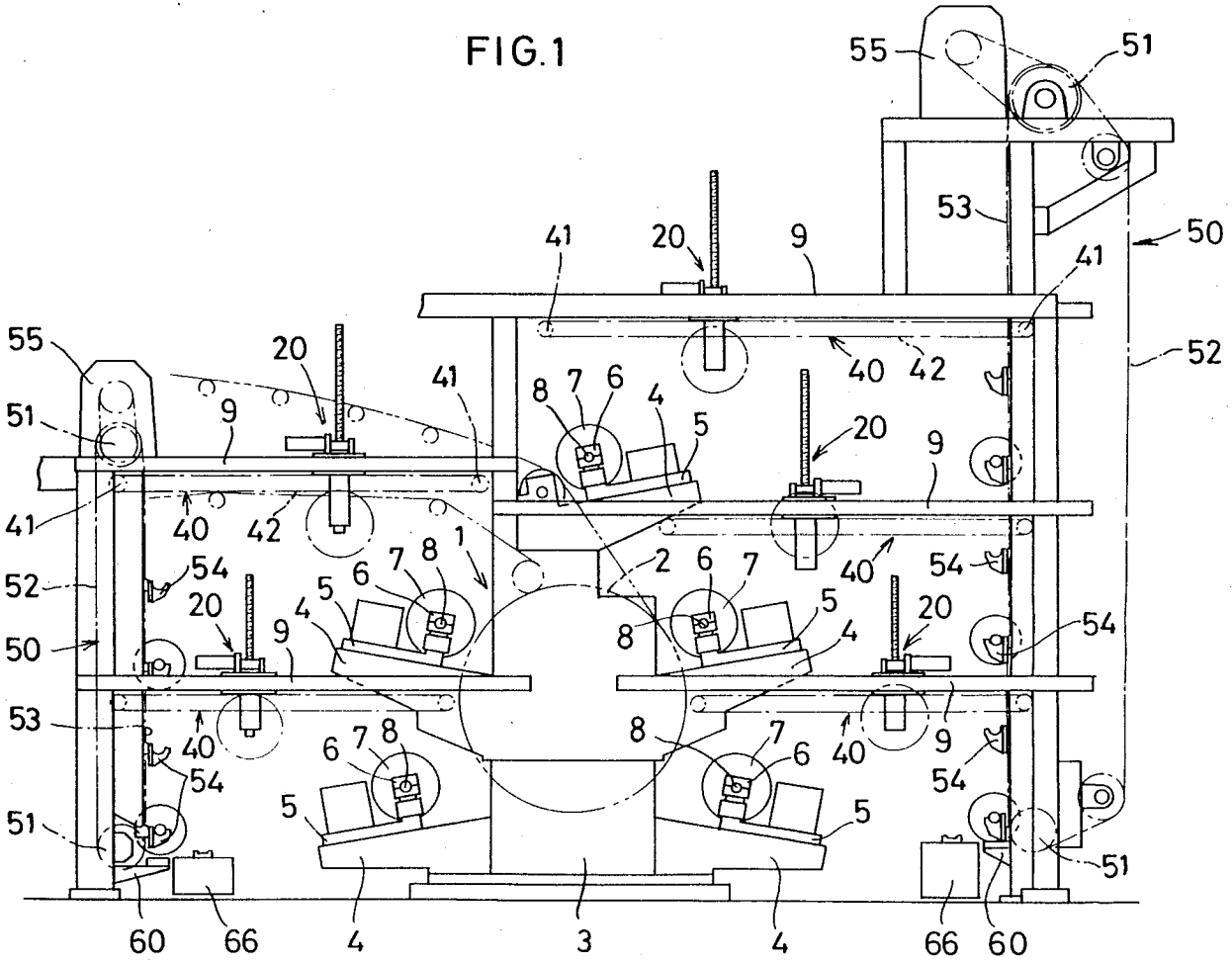
FIG. 1 is a front view of the device for replacing plate cylinders embodying the present invention.

Referring to FIG. 1, a rotary press 1 for color printing has an impression cylinder 2, a pair of side frames 3 for supporting the impression cylinder, a plurality (five in the embodiment) of beds 4, and plate cylinder carriers 5 each slidably mounted on the beds 4 and provided with a bearing 6 for turnably supporting one end of a shaft 8 of a plate cylinder 7.

Figure 7:
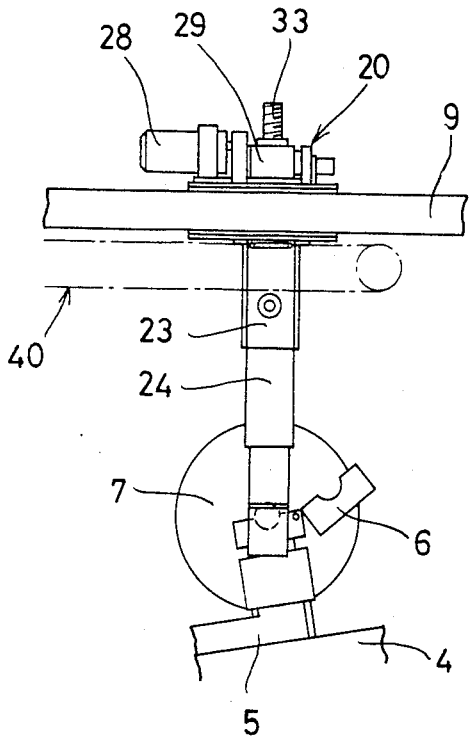
FIG. 7 is a front view showing how the used plate cylinder is picked up by the suspending unit.

Each plate cylinder carrier 5 is supported so as to be slidable toward the impression cylinder 2. The bearing 6 on each plate cylinder carrier 5 is a two-part unit (FIG. 7). With the bearing separated, the plate cylinder 7 can be pulled up off the bearing.

Figure 3:
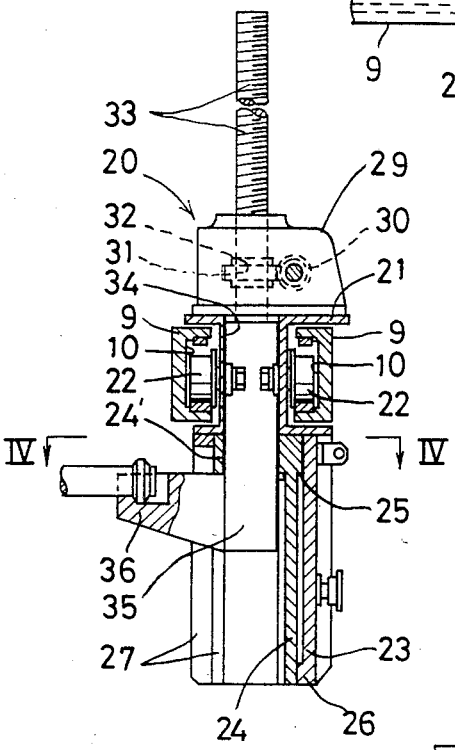
FIG. 3 is a vertical sectional side view of the suspending unit.

Over each plate cylinder 7, there are a pair of rails 9 arranged in parallel with each other and extending in a direction perpendicular to the axis of the plate cylinder. These rails serve as a guide member. As shown in FIG. 3, one opposed pair of rail segments 9 form one set, each having a guide groove 10 in its inner side. A cylinder suspending unit 20 is supported so as to be slidable along a pair of the guide grooves 10.

Figure 2:
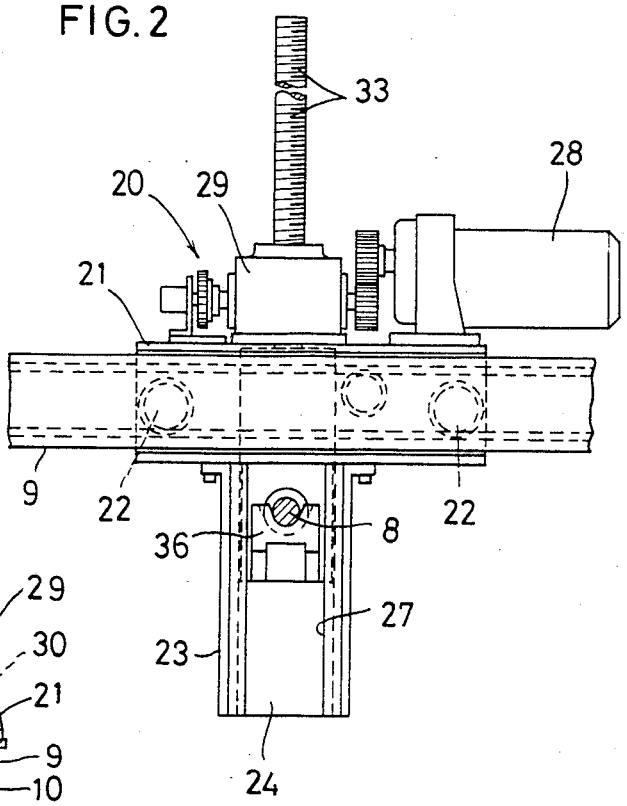
FIG. 2 is a front view of a suspending unit used in the device.
Figure 4:
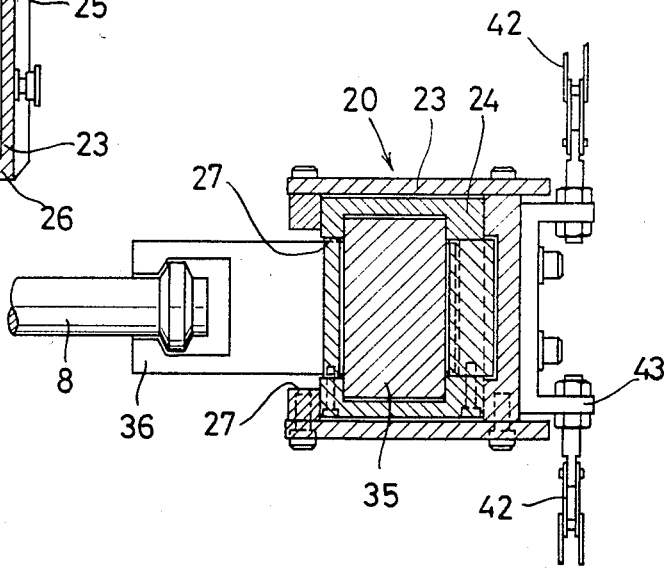
FIG. 4 is a sectional view taken along the line IV—IV of FIG. 3.

As shown in FIGS. 2–4, the suspending unit 20 comprises a motor base 21 having rollers 22 secured to each side thereof so as to roll in the rails 9. The top of an outer guide tube 23 is secured to the lower end of the motor base 21. An inner tube 24 is fitted in the outer guide tube 23 and adapted to fall under its own weight until its stepped portion 25 abuts on a shoulder 26 formed on the inner wall of the outer tube 23. The outer guide tube 23 and the inner tube 24 are formed with a guide slot 27 (FIG. 4) extending in a vertical direction.

A motor 28 and a gear case 29 are supported on the motor base 21 (FIG. 2). The gear case 29 accommodates a worm gear 30 driven by thc motor 28 and a worm wheel 31 engaging the worm gear. (FIG. 3) The worm wheel 31 is adapted to turn at a fixed position and has a threaded hole 32 in its center. A threaded shaft 33 threadedly engaging the threaded hole 32 extends upwardly through the gear case 29.

A bearing support 35 is secured to the lower end of the threaded shaft 33 and is disposed in a hole 34 formed in the center of the motor base 21. (FIG. 3) The bearing support 35 has its lower end fitting in the inner tube 24. A top-open bearing 36 secured to the lower end of the bearing support 35 protrudes outwardly from the guide slots 27 formed in the outer guide tube 23 and the inner tube 24. (FIG. 4) Also, the bearing 36 engages a top plate 24' of the inner tube 24 to prevent the latter from falling under its own weight. (FIG. 3)

One pair of the abovesaid suspending units 20 are provided for each plate cylinder. The motors 28 for the pair of the suspending units are controlled to be turned on and off at the same time so that the plate cylinder suspended by them will never be tilted.

The suspending unit 20 of the abovesaid structure is adapted to move along the rail 9 when a traveller 40 is driven. (FIG. 1) The traveller 40 comprises a pair of sprockets 41 (FIG. 1) arranged under each rail 9 at each end thereof, and a chain 42 passing around the sprockets 41 having its ends secured to a chain clamp 43 secured to an upper portion of the outer guide tube 23. (FIG. 4)

One pair of the abovesaid travellers 40 are provided for each plate cylinder. One of their two sprockets is driven by a common motor (not shown) through a common driving shaft (not shown) so that the pair of the travellers for each plate cylinder will be driven in synchronization.

The traveller 40 in the preferred embodiment is a mere example. The traveller may comprise a rack as a guide member, a pinion turnably mounted on the suspending unit 20 to engage the rack, and a motor mounted on the suspending unit for driving the pinion, so that the suspending unit will travel along the rack. In such an arrangement, too, the motors are controlled so that the pair of travellers will be driven in synchronization.

At the outer ends of the rails 9, namely, at each side of the rotary press 1, a pair of elevator conveyors 50 for raising and lowering the plate cylinders 7 are arranged. Each of the elevator conveyors 50 comprises sprockets 51 arranged one above the other, an endless chain 52 passing around the sprockets 51, and a plurality of top-open bearings 54 secured to the endless chain 52. The inner path of the endless chain 52 crosses the rails 9 of the travellers 40. One of the pair of the elevator conveyors 50 have the bearings 54 secured at the same level or height as the bearings of the other elevator conveyor. One of the sprockets 51 of the pair of elevator conveyors 50 are driven by a common motor 55 through a common driving shaft (not shown) for synchronous drive.

The number of the bearings 54 may be decided depending on the number of the plate cylinders arranged at each side of the impression cylinder 2. In the embodiment of FIG. 1, there are two plate cylinders 7 to the left of the impression cylinder 2 and three plate cylinders to its right. In this embodiment, the lefthand pair of the elevator conveyors 50 each should preferably have four or more bearings 54 and the righthand pair of them each should have six or more bearings 54.

Figure 5:
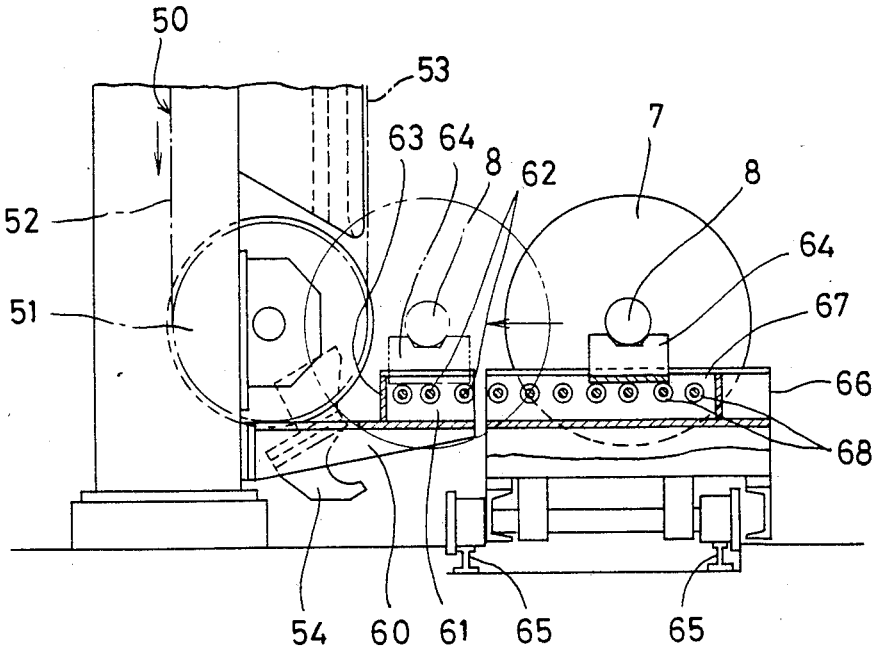
FIG. 5 is a vertical sectional front view of the lower portion of the elevator conveyor used in the device.
Figure 6:
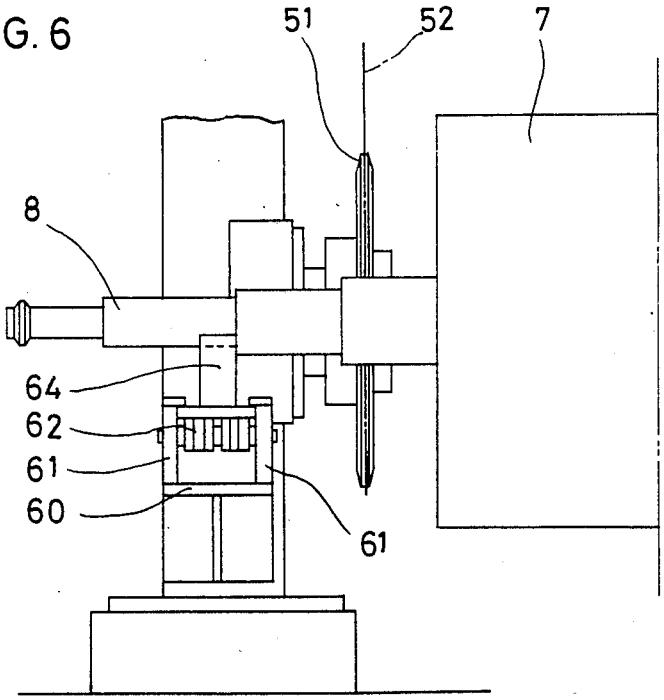
FIG. 6 is a side view thereof.

As shown in FIGS. 5 and 6, at bottom of each elevator conveyor 50, there is a roller support arm 60 from which a pair of roller support plates 61 extend upwardly to turnably support a plurality of rollers 62 therebetween. A positioning plate 63 is provided at one end of the roller support plates 61. A block 64 for supporting the plate cylinder is passed onto the rollers 62 from the other end. With the block 64 butting the positioning plate 63, the axis of the plate cylinder 7 supported on the block 64 is perpendicular to the track on which the bearing 54 moves.

In front of each roller support arm 60, a pair of rails 65 are provided to extend in a direction perpendicular to the roller support arm 60. A handcar 66 is supported so as to be movable along the rails 65. On the handcar 66, a pair of roller support plates 67 are provided to turnably support a plurality of guide rollers 68 therebetween.

In use, the shaft 8 of the plate cylinder 7 to be used next is supported on a pair of the blocks 64 which are on the rollers 68 in the handcar 66. The handcar is pushed to move on the rails 65 until the roller support plates 67 on the handcar 66 are aligned with the roller support plates 61 on each roller support arm 60. The blocks 64 are then moved from on the rollers 68 on the handcar 66 to on the rollers 62 on the roller support arms 60 until the blocks abut the positioning plates 63. The chains 52 of the elevator conveyors 50 are moved in the direction of arrow on FIG. 5 until the bearings 54 secured to the chains 52 engage the shaft 8 of the new plate cylinder 7 from under. The plate cylinder 7 is then conveyed upwardly by the elevator conveyors 50.

By repeating the abovesaid step, a plurality of new plate cylinders 7 can be supported on the bearings 54 of the elevator conveyors 50. The pair of the bearings 54 just above the one supporting the plate cylinder should be kept vacant, as shown in FIG. 1. This work for preparing the next plate cylinders may be performed while the rotary press 1 is in operation.

In order to replace the old plate cylinder 7 with a new one, firstly get it away from the impression cylinder 2 and then drive a pair of the travellers 40 in synchronization to move a pair of suspending units 20 along the rails 9 toward the plate cylinder 7 that has been used, until they come obliquely over the plate cylinder. The motors 28 (FIG. 2) of the pair of the suspending units 20 are then started at the same time.

As each worm wheel 31 is driven through the worm gear 30, the threaded shaft 33 will go down. When a pair of the bearings 36 secured to the bottom of the threaded shafts 33 through the bearing supports 35 come below the shaft 8 of the plate cylinder 7, the motors 28 are stopped. The travellers 40 are then driven to move the suspending units 20 to such a position where the bearings 36 are just under the shaft 8. The motors 28 are actuated to raise the threaded shafts 33 to bring the bearings 36 into engagement with the shaft 8 of the plate cylinder 7 at each end thereof, suspending the used plate cylinder 7 (FIG. 7). The bearings 6 on the plate cylinder carriers 5 are separated beforehand into two units for their upper half not to prevent the plate cylinder from being suspended.

Figure 8:
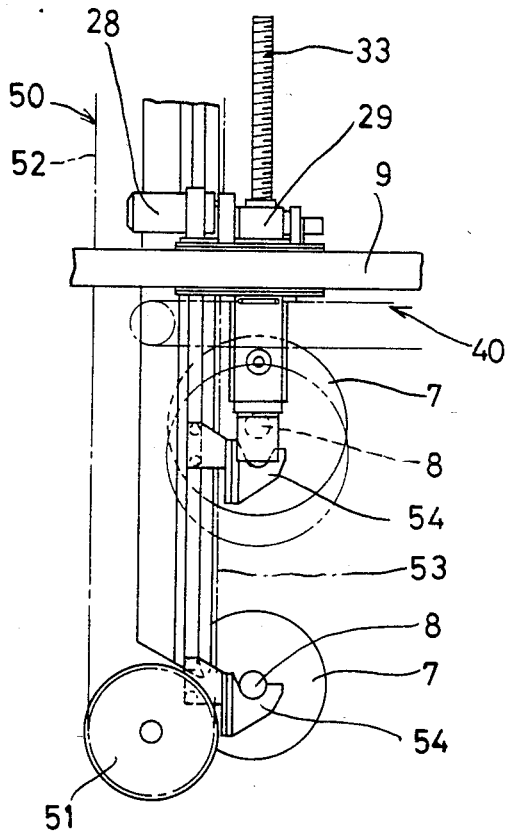
FIG. 8 is a front view showing how the plate cylinder supported by the suspending unit is received on a bearing of the elevator conveyor.

The used plate cylinder 7 supported on the bearings 36 is moved to above the vacant bearings 54 on the elevator conveyors 50, by actuating the motors 28 and the travellers 40 suitably. Either the bearings 36 are then lowered, or the vacant bearings 54 on the elevator conveyors 50 are raised until the shaft 8 of the plate cylinder 7 is supported on the bearings 54 (FIG. 8). The suspending units 20 are moved away from the elevator conveyors 50 not to obstruct their operation.

The vertical portions 53 of chains 52 of the elevator conveyors 50 are moved upwardly to move the plate cylinder 7 to be used next to a desired height. The new plate cylinder is received on the bearings 36 of the suspending units 20 either by raising the vacant bearings 36 toward the new plate cylinder on the bearings 54 or by lowering the latter toward the former. The suspending units 20 are then moved by the travellers 40 along the rails 9 until the plate cylinder 7 comes right over the bearings 6 of the plate cylinder carriers 5. The motors 28 are actuated to lower the bearings 36 until the shaft 8 of the new plate cylinder 7 gets on the bearings 6 on the plate cylinder carriers 5. This completes the replacement of the plate cylinder 7.

On the other hand, the used plate cylinder 7 supported on the bearings 54 of the elevator conveyors 50 is lowered onto the blocks 64 which are on the rollers 62 on the roller support arms 60. It is then moved on to the rollers 68 on the handcar 66 and is moved to its storing station by moving the handcar along the rails 65.

Such a locus of the movement of the bearings 36 may be determined beforehand and memorized in a controller that the plate cylinder 7 supported on the suspending units 20 will be conveyed within the shortest possible period of time without colliding or bumping any other part of the press. The suspending units 20 for moving the plate cylinder vertically and the travellers 40 for moving it horizotally may be controlled by use of the signals from the controller memorizing such a locus. Further, the elevator conveyors 50 may be controlled to coordinate the movement of their bearings 54 with the movement of the bearings 36 so that the replacement work will be controlled fully automatically.

The arrangement of the present invention is such that all of the plate cylinders on one rotary press can be replaced automatically and simultaneously.

What we claim:

1. A device for replacing plate cylinders for a color printer having a plurality of plate cylinders, said device comprising:

a plurality of pairs of suspending means having a bearing adapted to support one end of the shaft of the plate cylinder and to be movable in a vertical direction for suspending the plate cylinder;

a plurality of pairs of travelling means for moving the plate cylinder supported on said suspending means in a horizontal direction; and at least one pair of elevator conveyors having a conveyor body movable up and down and a plurality of bearings secured to said conveyor body for supporting each end of the shaft of the plate cylinder;

the bearings of said suspending means and the bearings of said elevator conveyors being arranged so that the plate cylinder on the bearings of said suspending means will be received by the bearings of said elevator conveyors either by moving the bearings of said suspending means downwardly past the bearings of said elevator conveyor or moving the latter upwardly past the former and so that the plate cylinder on the bearings of said elevator conveyor will be received by the bearings of said suspending means either by moving the bearings of said elevator conveyor downwardly past the bearings of said suspending means or moving the latter upwardly past the former.

2. The device as claimed in claim 1, wherein said suspending means comprises a threaded shaft extending vertically, a worm wheel engaging said threaded shaft, a worm gear engaging said worm wheel, and drive means for driving said worm gear to raise and lower said threaded shaft, said bearing being secured to the bottom of said threaded shaft.

3. The device as claimed in claim 1, wherein said travelling means comprises a guide rail extending over the plate cylinder in a direction perpendicular to the axis of the plate clyinder, a pair of sprockets arranged under said guide rail, a chain passing around said sprockets, and drive means.

4. The device as claimed in claim 1, wherein the bearings of said suspending means and the bearings of said elevator conveyors are of a top-open type.

* * * * *